United States Patent [19]

Gartung

[11] 3,934,382

[45] Jan. 27, 1976

[54] MODULAR SOUND-ABSORBING SCREENS

[76] Inventor: Clifford W. Gartung, 407 E. Edgewater, Balboa, Calif. 92661

[22] Filed: Feb. 27, 1974

[21] Appl. No.: 446,127

[52] U.S. Cl. ..... 52/144; 52/241; 52/281; 52/624; 181/33 G

[51] Int. Cl.[2] ..... E04B 1/82; E04C 2/38

[58] Field of Search ..... 52/145, 144, 239, 241, 52/404, 624, 627, 281, 282; 181/30, 33 G, 33 GB

[56] References Cited

UNITED STATES PATENTS

| | | | |
|---|---|---|---|
| 2,350,513 | 6/1944 | Leadbetter | 52/145 |
| 2,708,494 | 5/1955 | Larsen | 52/281 |
| 2,833,003 | 5/1958 | Bourne et al. | 52/620 |
| 2,914,147 | 11/1959 | Millard | 52/222 |
| 3,033,330 | 5/1962 | Fowles et al. | 52/127 |
| 3,037,593 | 6/1962 | Webster | 52/476 |
| 3,210,898 | 10/1965 | Kurtz | 52/281 |
| 3,330,084 | 7/1967 | Russell | 52/300 |
| 3,378,951 | 4/1968 | Malone | 49/127 |
| 3,592,288 | 7/1971 | Walter | 181/33 G X |
| 3,592,289 | 7/1971 | Aysta et al. | 181/30 X |
| 3,667,175 | 6/1972 | Bjorksten | 52/144 |
| 3,713,508 | 1/1973 | Eckel | 181/33 G X |
| 3,748,799 | 7/1973 | Tough et al. | 52/144 |
| 3,766,696 | 10/1973 | Totoonchie | 52/241 |
| 3,768,222 | 10/1973 | Birum | 52/239 |

*Primary Examiner*—Price C. Faw, Jr.
*Attorney, Agent, or Firm*—Christie, Parker & Hale

[57] ABSTRACT

A number of modular office screens are assembled to provide movable sound-absorbing partitions for offices and the like. Each office screen includes a modular sound-absorbing panel comprised of a rigid sound-reflecting core, a separate compressible layer of fibrous material on each side of the core for absorbing and dissipating sound energy coming from opposite sides of the core, and a channel-shaped frame extending around the perimeter of the panel. The sound-absorbing panel is slidably mounted in the channel-shaped frame and releasably held in the frame without the aid of tools or fasteners. A number of such screens are interconnected in various floor plan configurations also without requiring tools or fasteners, by releasably mounting the bottom portions of the frames in fixed upright channel-shaped base members adapted to rest on the floor and arranged in the desired floor plan configuration for each junction of two or more screens. The top portions of the screens are held together by releasable clip members frictionally engaged with adjoining portions of the frames, and by channel-shaped cover plates releasably fitted over one or more of the clips and bridging the interface of adjoining frames for holding the screens in their desired configuration and for preventing relative movement between the tops of the screens.

14 Claims, 6 Drawing Figures

22'
10
51
48
14
24'
50'
10
22'
24
50
48
24'
14
26'
12
12
24
14
22
14
42
40
46
136
136
42
44
40

MODULAR SOUND-ABSORBING SCREENS

BACKGROUND

This invention relates to modular office screens for providing movable sound-absorbing partitions for offices and the like. More particularly, the invention includes a modular screen construction having good sound-absorbing properties, and a system for assembling each screen and for interconnecting a number of such screens in a variety of desired floor plan configurations without the use of tools or conventional fasteners such as nuts and bolts.

In recent years, new building structures, whether they are intended for commercial, industrial, or educational purposes, have included permanent load-bearing exterior walls, and a variety of semi-permanent non-load-bearing interior partition systems for partitioning off large "open landscape" areas in the building to form a number of work enclosures in the building. Such semi-permanent partition systems permit the use of relatively inexpensive partitioning materials instead of fixed and permanent load-bearing walls, making removal of the original partitions and subsequent modification and rearrangement of the floor plan a much more rapid and inexpensive process.

A number of semi-permanent partition systems in common use today include mounting tracks which are fixed to the floor and ceiling to provide partitioning boundary lines, and studs fastened or snap-fitted at spaced intervals in the floor and ceiling tracks. Non-load-bearing panels normally made of plywood or mineral material such as gypsum are supported in a variety of ways against the studs.

In another type of semi-permanent partition system in common use today, the mounting track is affixed only to the floor, and panels about four to five feet in height are supported in a variety of ways against studs of the same height which are fastened to or snap-fitted at spaced intervals in the floor track.

In both types of prior art semi-permanent partitioning systems, material costs are high and substantial labor costs are required for the construction, assembly and disassembly of the systems. A major portion of the labor cost results from the use of conventional fasteners to put the bottom and/or top tracks in place and then fasten the studs to the tracks.

As a result of the time and expense involved in assembling and disassembling semi-permanent partition systems, open landscape areas of commercial, industrial and educational facilities have recently been partitioned off by modular "office screens" consisting of free-standing movable partitions which are not fastened directly to the floor or ceiling. The office screens are simply assembled individually and connected together to form the desired floor plan configurations.

The major advantages of modular office screens are much greater mobility because of the reduced time and labor involved in assembling or disassembling them when compared with semi-permanent partition systems, and lower costs in terms of materials. Because of their improved mobility, they can be used to change the floor plan arrangement of an open landscape areas overnight, for example. However, modular office screens presently in use have several disadvantages, among which are the lack of good sound-absorbing properties and the inability of being easily and quickly assembled and disassembled or connected together without the need for special tools, complicated attachment devices, or conventional fasteners such as nuts, bolts, screws, and the like. The need for good sound dissipating properties is especially critical for office screens because they generally extend for only a portion of the vertical distance between the floor and ceiling.

SUMMARY

This invention provides a modular office screen construction having exceptionally good sound-absorbing properties. The office screen also is constructed so it can be easily and quickly assembled, disassembled, and connected in a variety of floor plan arrangements without the need for conventional fasteners, special tools, or complicated attachment devices.

Briefly, the office screen construction includes a modular sound-absorbing panel comprising a rigid core having good sound-reflective properties, and sound-absorbing layer on each side of the panel. Each layer is a compressible, substantially non-cellular material providing means for absorbing and dissipating sound energy. A rigid frame structure surrounds the perimeter of the sound-absorbing panel to provide an upright sound-absorbing screen for serving as a movable partition.

Preferably, the sound-absorbing layer comprises a sheet of fibrous material, such as a layer of compressible glass fibers, of sufficient thickness to act as means for absorbing and dissipating sound energy directed toward the layer.

The invention also provides an easily assembled and disassembled composite office screen system which includes means for releasably securing together two or more sound-absorbing panels to hold the panels in an upright position and in a desired orientation with respect to each other. The perimetric frame structure of each panel preferably is of channel-shaped cross-sectional configuration and is slidably mounted in fixed upright channels of a base assembly resting on the floor and adapted to hold the bottom portions of one or more frames in fixed orientations relative to each other. The top portions of two or more screens are releasably interconnected by rigid mounting clips frictionally engaged with the points of junction between the screens to hold the screens in their desired orientations. Each mounting clip preferably includes a top portion for resting on the top surface of two adjoining frames, and a side portion releasably engaged with a separate side portion of each frame to hold the two frames together by preventing longitudinal movement of each frame relative to the other. A cover plate of channel-shaped cross-sectional configuration is releasably disposed over one or more of the clip members to releasably engage the opposite side portions of the adjoining frames in a snug fit for preventing lateral movement of each frame relative to the other. The mounting clips and the releasable cover plate allow a number of such screen structures to be easily interconnected in a variety of configurations without requiring special tools or fasteners.

These and other aspects of the invention will be more fully understood by referring to the following detailed description and the accompanying drawings.

DRAWINGS

DESCRIPTION

Figure 1:
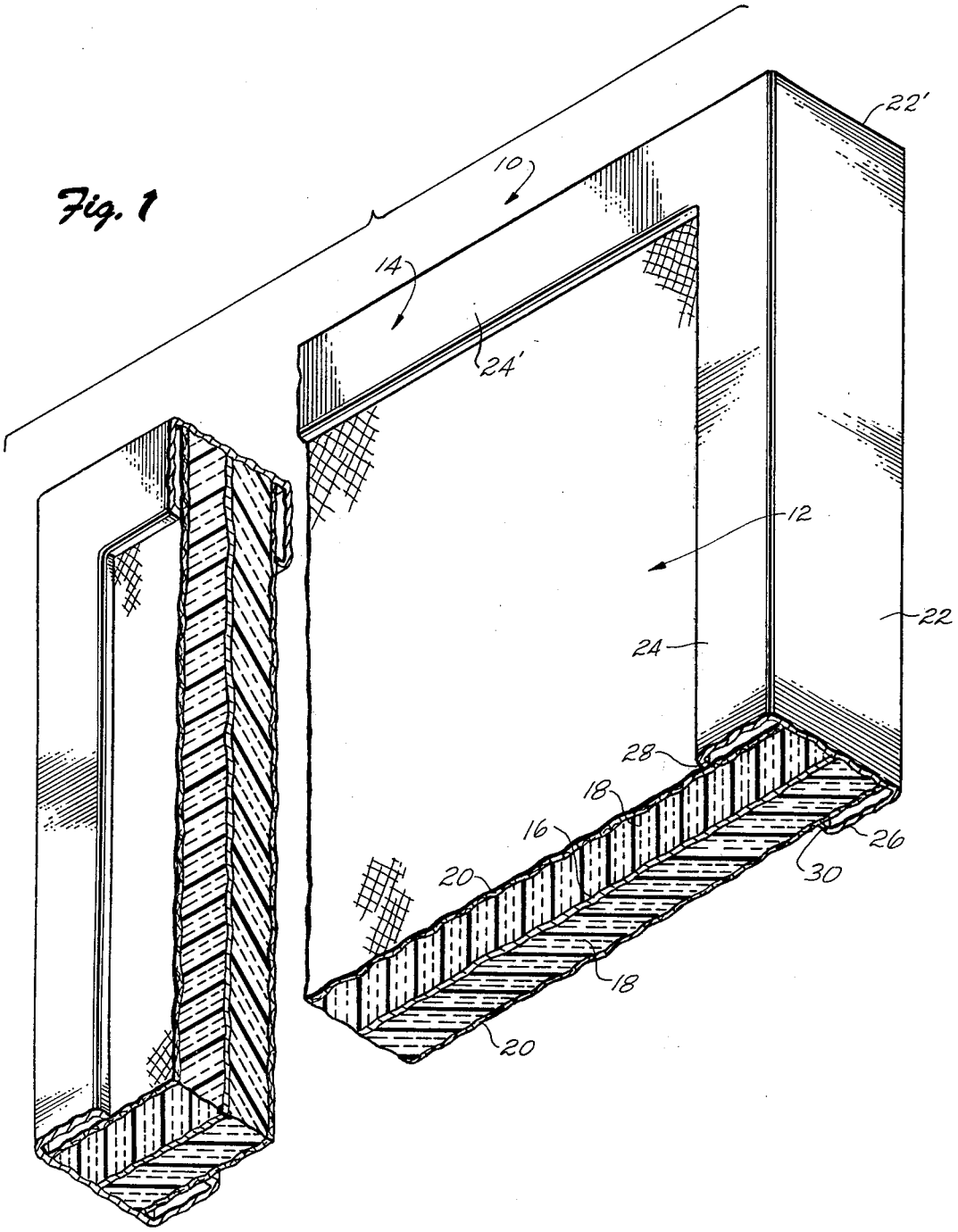
FIG. 1 is a fragmentary perspective view, partly in cross-section, showing a modular office screen according to this invention in its assembled form.

FIG. 1 shows an office screen 10 comprised generally of a sound-absorbing panel 12 releasably mounted in a downwardly opening U-shaped sheet metal frame 14 which fits around the perimeter of the sound-absorbing panel. The bottom portions of frame 14 are connected with a base structure (to be described in detail below) which holds the office screen in a free-standing, upright position on the floor. The office screen provides a highly mobile sound-absorbing partition which can be engaged with other identical office screens to form movable partition systems in a variety of floor plan arrangements for partitioning off open landscape areas of commercial, industrial, and educational facilities, for example.

Sound-absorbing panel 12 preferably includes a center core 16 made of a flat piece of sheet metal. Preferably, core 16 is a sheet of 20 gauge cold rolled steel. Its main purpose in the panel is to act as a sound-reflective surface for sound coming from either side of the core. Therefore, it is critical that core 16 be made from a rigid material which is non-porous, non-cellular, or non-perforated, so the core will reflect sound energy rather than absorbing it or letting it pass through to the other side of the screen.

A separate layer 18 of sound-absorbing material overlies each face of core 16. Preferably, each sound-absorbing layer consists of a non-cellular, compressible material having good sound-absorbing and dissipating properties. A good sound-absorbing layer is provided by a fibrous material such as a batting of compressible glass fibers sold as No. 704 Owens-Corning 4.25 les density spun Fibre Glass. Preferably, each layer 18 is at least about 1 inch thick. The thickness of the layer can vary, although it should provide a sufficient thickness of fibrous material to produce the desired amount of sound absorption and dissipation. I have found that the compressible, fibrous layer 18 has exceptionally good sound-absorbing and dissipating properties. For example, a material which is cellular, such a polyurethane foam, does not adequetely absorb or dissipate sound energy, because of the large number of voids through which the sound is able to pass rather than being deadened by the material. Rigid materials, such as gypsum board, or even rigid cellular material such as polyethylene or polyvinyl foam, also are not suitable because their rigidity merely reflects the sound rather than absorbing it The sound-absorbing layers 18 can provide the exterior surfaces for panel 12. However, if layers 18 are covered, the material covering them should be porous. An outer layer 20 of any porous material desired for a covering overlies the exterior face of each sound-absorbing layer 18. A preferred material for covering 20 is 100% Polyester Dacron fabric which provides a homogeneous porous facing for each face of the screen to allow substantially all the sound directed against the panel to pass into the glass fiber layers. Outer layers 20 preferably are made from a material which is flexible as well as porous. The outer layers should not be solid or rigid, so that the maximum amount of sound energy can pass into each layer 18 rather than being reflected by the outer layers. The covering is not glued to the glass fiber layer 18 so that maximum sound may pass into the glass fiber layer rather than being reflected or impeded by a layer of glue or other similar adhesive or bonding material between the two layers. Preferably, the use of glue is avoided by draping a continuous cover layer 20 over both exterior faces of the glass fiber layers 18 and the center core 16, and then fastening the cover at the sides and bottom by some suitable means, such as by stapling.

The relatively rigid center core 16 provides a strong foundation for the layers of glass fibers and the outer covering, besides being an effective baffle which prevents sound from one side of the panel from travelling through the panel to the other side.

The completed sound-absorbing panel 12 is slidably engaged with frame 14 prior to connecting the bottom portions of frame 14 to the screen base structure so that the screen will be held in an upright position to provide a suitable partition. As shown best in FIGS. 1 and 2, frame 14 is a downwardly opening U-shaped member of channel-shaped cross-sectional configuration. The channel includes an elongated base portion 22, an elongated U-shaped flange 24 extending around the perimeter of one face of the sound-absorbing panel 12, and a second U-shaped flange 26 extending around the perimeter of the opposite face of the sound-absorbing panel. Preferably, flanges 24 and 26 are one-half the length of base portion 22. An elongated inwardly turned marginal lip 28 extends along the remote end of flange 24, and a second inwardly turned marginal lip 30 extends along the remote end of flange 26. (For the convenience of the description below, the channel base portion which forms the top surface of frame 14 is numbered 22', and the portions of flanges 24 and 26 which form the top side portions of the frame will be numbered 24' and 26'.)

Sound-absorbing screen 10 is assembled by sliding the modular sound-absorbing panel 12 into the bottom of the U-shaped channels provided by frame 14 until the top edge of the sound-absorbing panel abuts against the inner face of base portion 22' at the top of frame 14. The width of the channel provided by frame 14 is such that lips 28 and 30 bear against the opposite faces of sound-absorbing panel 12 to squeeze the components of the panel around the perimeter of the panel so as to releasably hold the panel in the frame.

The upright leg portions of frame 14 are longer than sound-absorbing panel 12 so that open-channel portions at the bottom of frame 14 (shown best in FIG. 3) can be releasably connected with a suitable channel-shaped base assembly to hold the assembled screen in a free-standing upright position to serve as a partition. When the sound-absorbing panel and its perimetric frame are in place, a channel-shaped bottom frame member 32 is slipped into the open-channel bottom portions of frame 14 to provide a horizontally extending bottom support member for the sound-absorbing panel. The ends of bottom frame member 32 are shaped to fit into the open-channel bottom portions of frame 14. The intermediate portion of each bottom frame member 32 provides an upwardly opening channel of the same cross-sectional shape and size as frame 14 to hold the bottom portions of the components of modular sound-absorbing panel 12.

Figure 2:
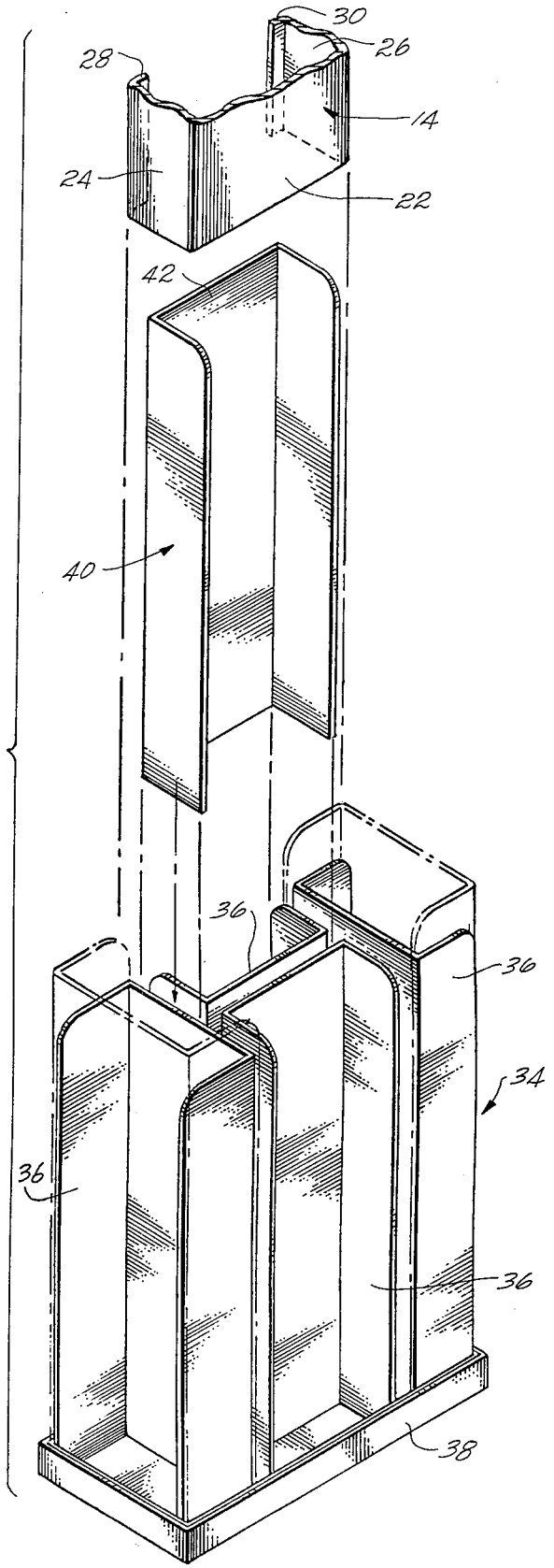
FIG. 2 is a fragmentary exploded perspective view showing one embodiment of means for assembling the base of the office screen.

Once bottom frame member 32 of the screen is in place, the open-channel bottom portions of the frame or a number of frames, are engaged with an appropriate base support member. The shape and configuration of the base support member depends upon the desired orientation of the screen with relation to other screens in the partition system being assembled. For example, FIG. 2 shows a movable base support assembly 34 for providing the bottom support for the equivalent of a post which will form the junction of four pre-assembled office screens interconnected in four 90° angles to form the corners for four partitioned areas. As shown best in FIG. 2, base assembly 34 includes four outwardly opening, upright channels 36 of U-shaped cross-sectional configuration. The bottoms of channels 36 are rigidly fixed to a rectangular-shaped base 38 which rests on the floor and holds each of the four channels in a rigid upright position so the four channels face outwardly in directions which are spaced 90° apart from each other. In use, base 38 is not fastened to the floor. Channels 36 are spaced apart from one another so that the spaces between them can accommodate the bottoms of channels slidably engaged with the outer surface of channels 36.

A given pre-assembled screen is releasably engaged with base assembly 34, for example, by initially slipping an upright channel 40 (see FIGS. 2 and 3) into the U provided by one of the fixed upright members 36 of base assembly 34. Upright channel 40 is of U-shaped cross-sectional configuration. Upright channel 40 is disposed in channel member 26 so that the top edge of a base portion 42 of channel 40 is spaced from the base portion of channel 36 and can thereby provide means of support for bottom member 32 to hold the completed screen assembly in place.

Figure 3:
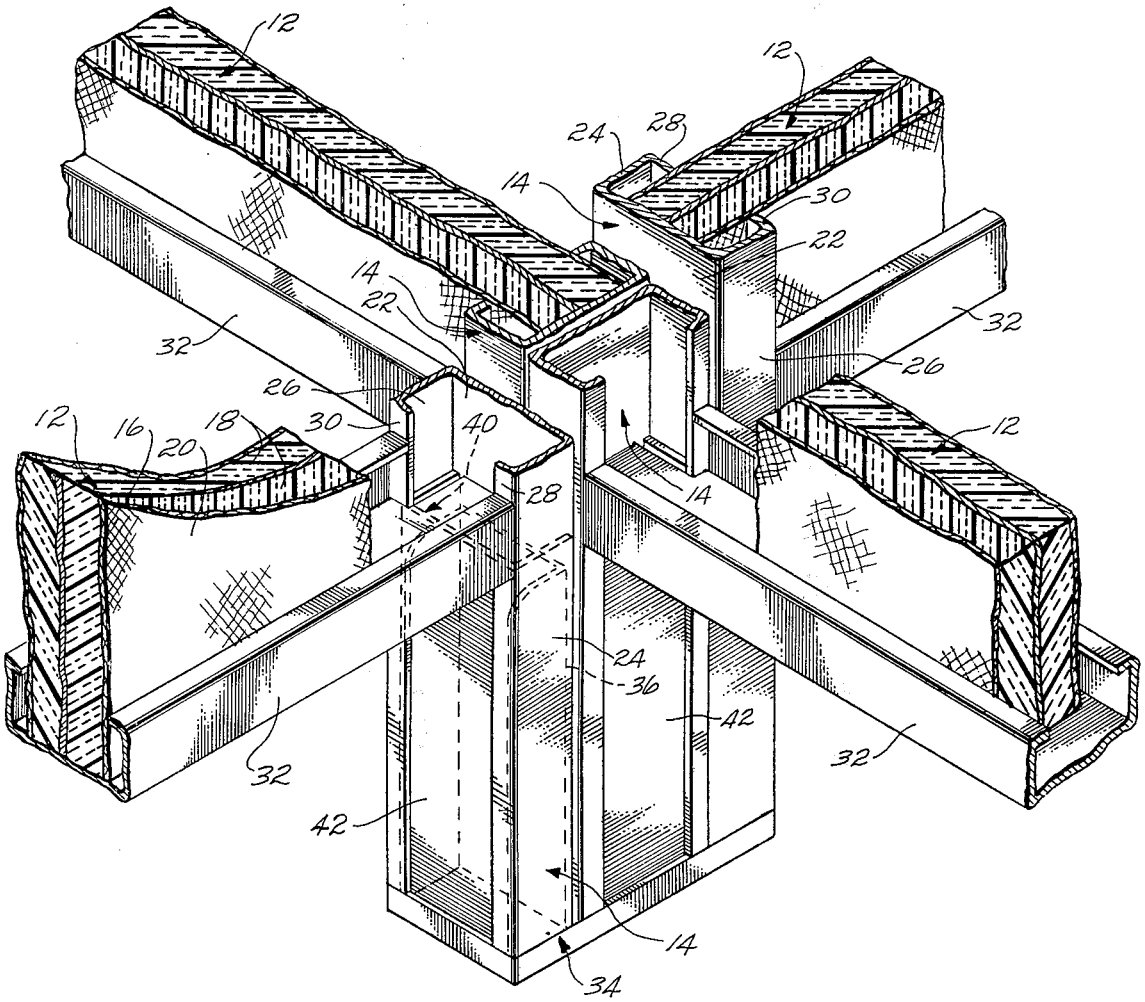
FIG. 3 is a fragmentary perspective view showing the base structure for the junction of four corners of a modular screen system.

FIG. 3 shows base assembly 34 in use providing means of support at the junction of four separate pre-assembled screens meeting at 90° angles to form four corners of a partition system.

Figure 4:
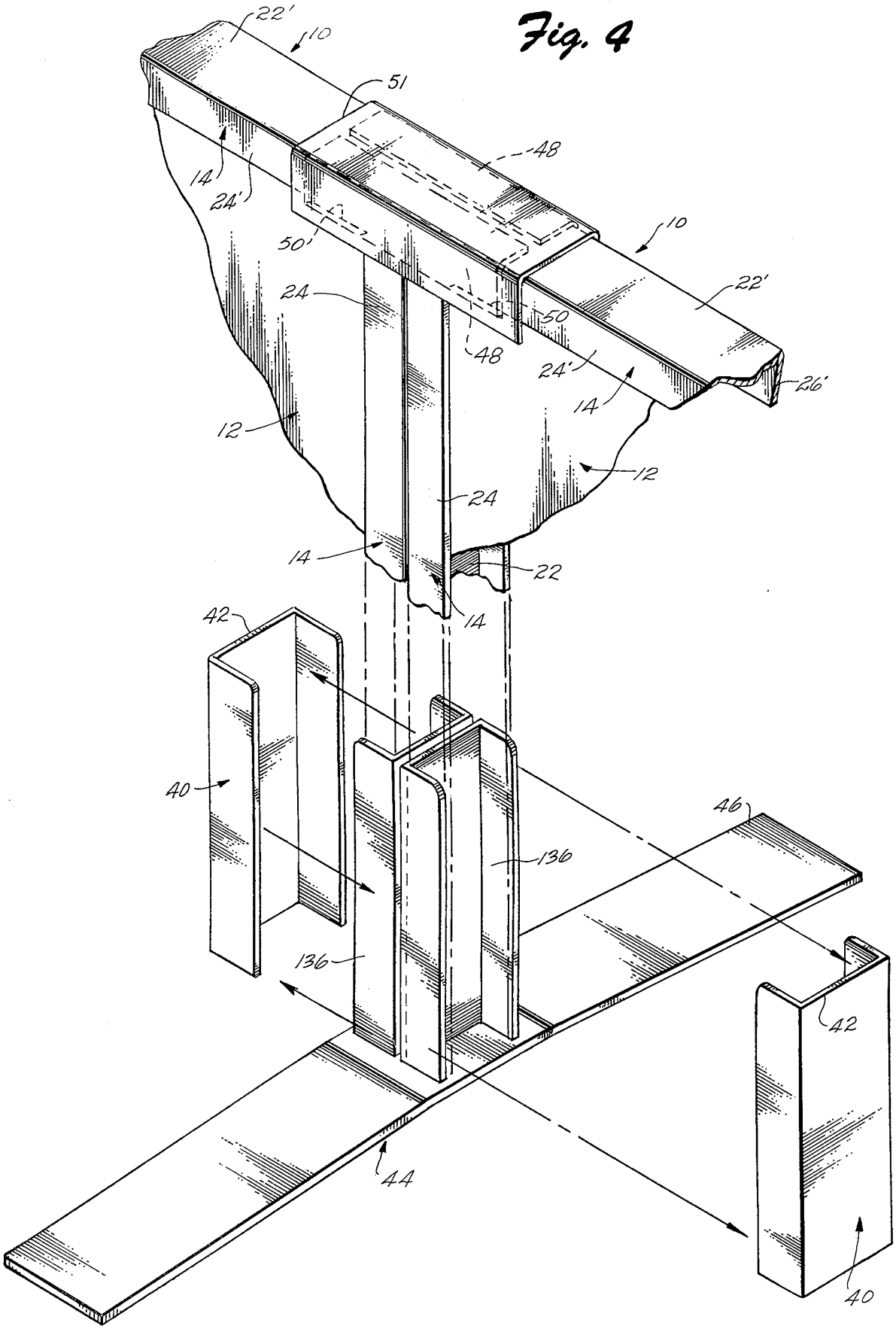
FIG. 4 is a fragmentary exploded perspective view showing the top structure and base structure for the junction of two screens assembled in a straight line to form a continuous wall.

FIG. 4 shows an alternate partition system in which a base assembly 44 provides means for holding together two pre-assembled screens in a straight line to form a continuous wall. Base assembly 44 includes an elongated base member 46 and a pair of spaced apart, upright fixed channel members 136 of U-shaped cross-sectional configuration facing in opposite directions. A pair of adjoining pre-assembled screens 10 are connected to base assembly 44 in a manner identical to that described above for base assembly 34. That is, in the assembly shown in FIG. 4, the open-channel bottom portions of perimetric frames 14 are slidably engaged around fixed upright channels 136. Inwardly opening, upright channels 40 are fitted into fixed upright channels 136 so the top edge of base portion 42 of each channel 40 will provide means for supporting the bottom channel 32 (not shown in FIG. 4 for clarity) of each screen attaced to base assembly 44.

The base assemblies for partition systems containing three screens, or for holding the bottom of one screen, are not shown in the drawings since they are arranged in a manner similar to base assemblies 34 and 44, respectively.

Figure 5:
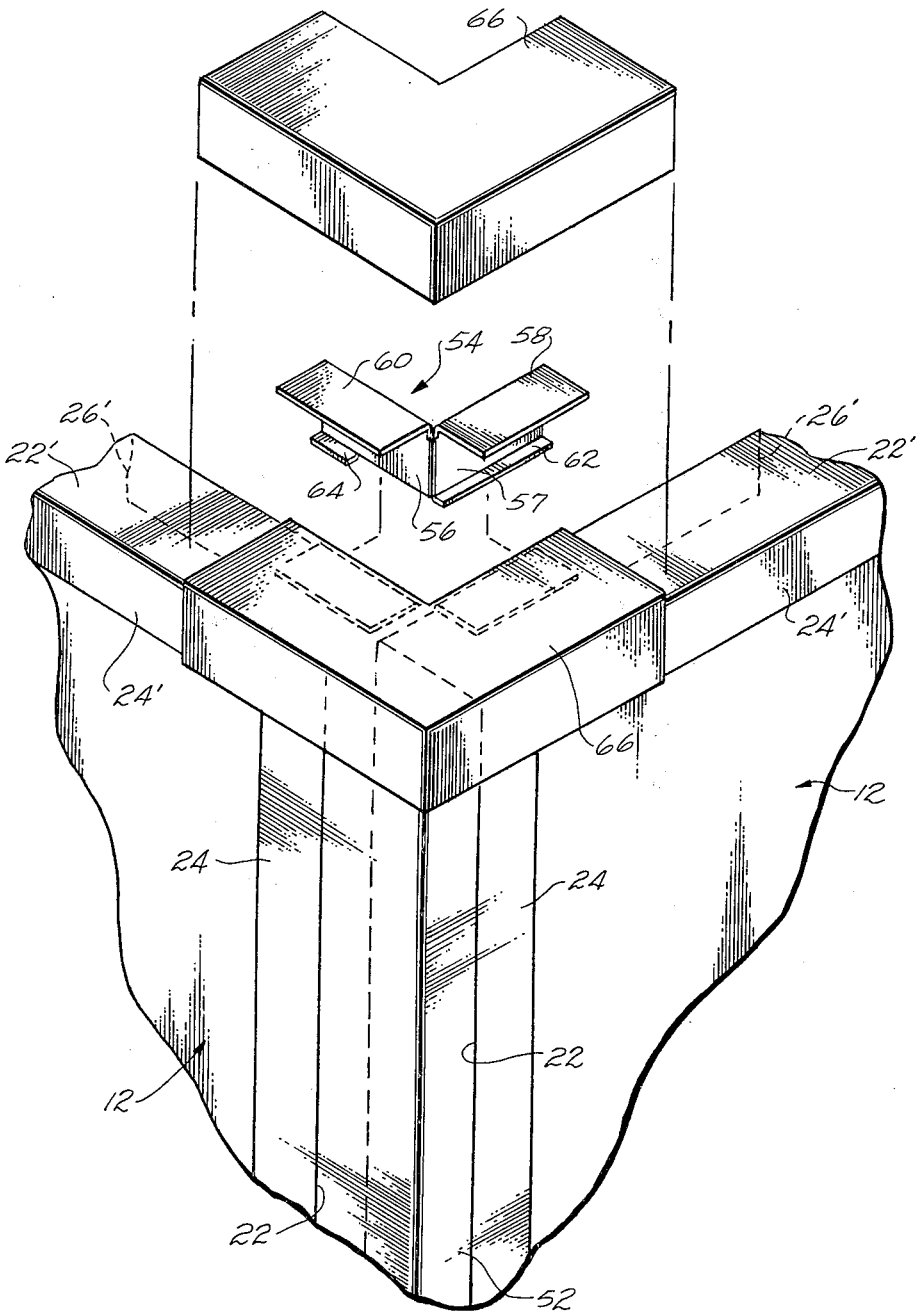
FIG. 5 is a fragmentary exploded perspective view showing the top structure of an office screen system in which two screens meet to form the corner of a partitioned area.
Figure 6:
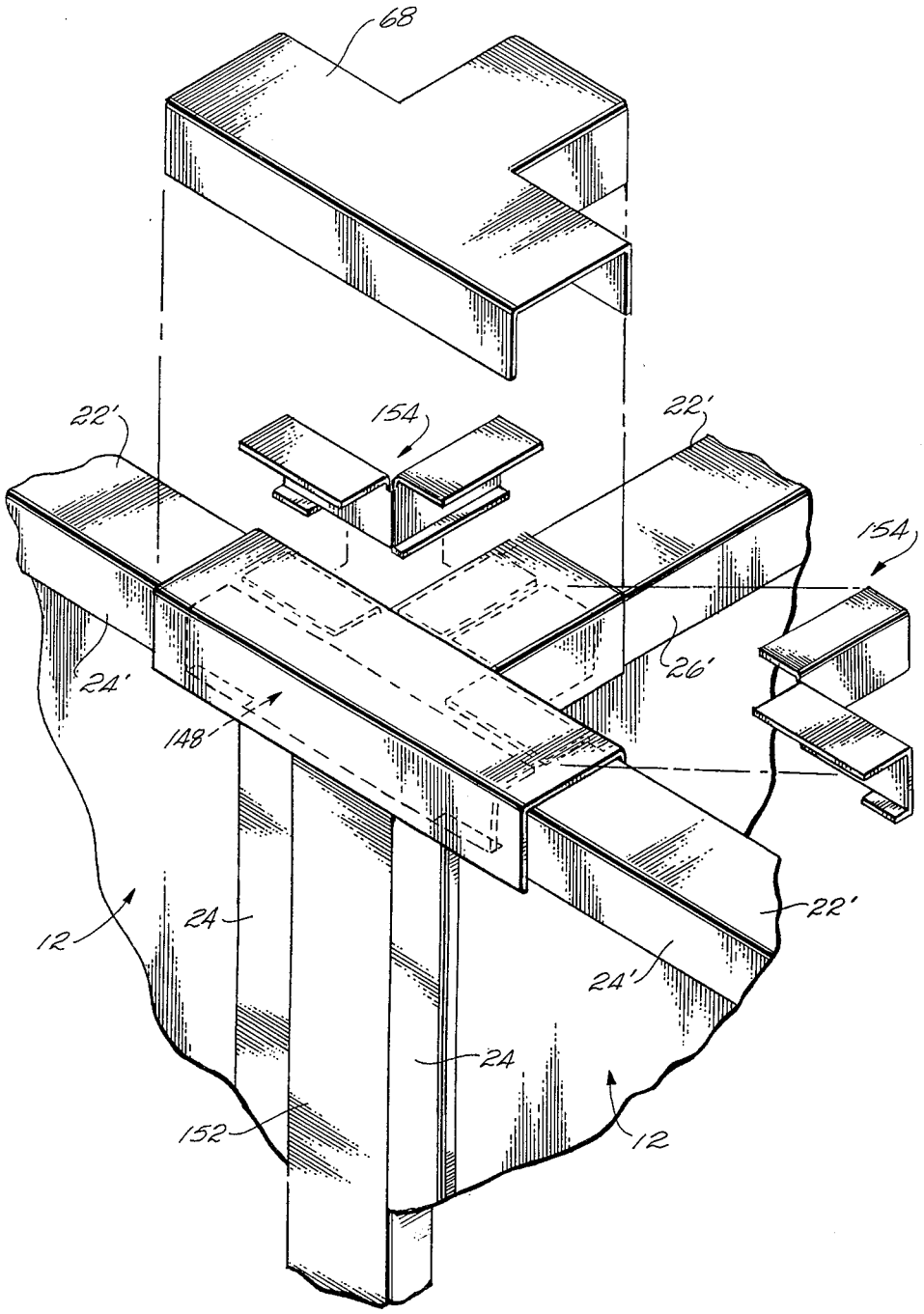
FIG. 6 is a fragmentary exploded perspective view showing the top structure of an office screen system in which three screens meet to form corners for two partitioned areas and a continuous wall for another partitioned area.

Once the bottoms of the screens are held in place by the appropriate base assemblies, the tops of the screens are then releasably fastened together by certain specially formed clip assemblies shown in FIGS. 4, 5, and 6. When two screens are connected to form a continuous linear wall, the clip assembly shown in FIG. 4 is used. This assembly includes a pair of elongated clip members 48 made of flat sheet metal bent into a right-angle configuration. The clip members extend along opposite corners of the two frames and bridge the junction of the two frames where the screens are joined in abutting end-to-end relation. The elongated top leg of each clip 48 rests on the two surfaces 22' of the adjoining frames. The downwardly depending leg of the one clip 48 lies flush against the two flanges 24' on one side of the two screens, and the downwardly depending leg of the other right-angle clip overlies the two flanges 26' on the other side of the two screens.

Each right-angle clip 48 has a pair of spaced apart inwardly turned, elongated flanges 50 extending along opposite end portions of the bottom edge of each downwardly depending leg of the flange. The distance between the opposite inner edges of the two flanges 50 provides a space just wide enough for receiving the two upright flanges 24 on one side of the two frames 14. The bottoms of the two flanges on one clip fit under the bottom edges of top flanges 24', and the inner edges of the two flanges 50 on the clip abut against the remote outer edges of upright flanges 24. The two flanges on the other clip fit under the edge of top flange 26' and also abut against the remote outer edges of flanges 26. Thus, the two clips make a tight friction fit with the two frames to hold the corner portions of the two screens together for preventing relative longitudinal movement between the two screens.

The top assembly of the two screens is completed by fitting a releasable cover plate 51 of channel-shaped configuration over the two right-angle clips 48 to hold the two clips in place at the junction between the two screens and also to prevent relative lateral or vertical movement between the top corner portions of the two interconnecting screens.

Thus, the two screens can be simply connected together by fitting the base portions of the screens into their appropriate base assemblies and then interconnecting the top portions of the two screens with a releasable clip assembly requiring no special tools or fasteners such as nuts, bolts, and screws, or other complicated attachment members.

FIG. 5 shows a mounting assembly for holding together the adjoining top portions of a pair of screens forming a 90° corner of a partitioned area. In this partition system, the ends of two screens are placed in abutting relation so that the corners of the two screens do not meet, but rather the upright flange portion 26 of one frame abuts against one-half the width of the upright end formed by base portion 22 of the other frame. A corner post 52 having a width equal to the width of base portion 22 of one frame and a thickness equal to one-half the width of base portion 22 of the other frame fills the space remaining at the corner of the two abutting screens.

A rigid sheet metal clip 54 bent into a right-angle configuration bridges the top portions of the two screens at the corner junction between the screens to hold the top portions of the screens in a fixed relation relative to each other. Mounting clip 54 includes base portions 56 and 57 extending at right angles to each other. A top flange 58 is bent at a right angle with respect to base portion 56, and a second flange 60 is bent at a right angle with respect to base portion 57. A long bottom lip 62 is continuous for the entire bottom edge of base 57. It extends at a right angle with respect to base 57 and also extends in the same direction as top flange 58. A short bottom lip 64 extends for only a short outer portion of the bottom edge of base 56. Lip 64 is bent at a right angle with respect to base 56 and extends in the same direction as top flange 60.

In use, clip 54 is mounted over the top corner portions of the two adjoining screens so that flanges 58 and 60 rest on the top surfaces 22' of the two screens. Lip 62 extends under the bottom edge of top flange 26' of one screen so that base 57 abuts against the vertical surface of flange 26'. The space between the inner edge of lip 64 and the corner of mounting clip 54 is just equal to the width of vertical flange 26 of the frame of the other screen, so that this portion of the frame can be received in the open space provided by the mounting clip and also allows base 56 to overlie top flange 26' of the screen. Thus, bottom lip 64 fits under the bottom edge of top flange 26', and the inner edge of bottom lip 64 bears against the vertical edge of vertical flange 26. When mounting clip 54 is in place, it makes a tight friction fit with the frame members of the two screens to restrain longitudinal movement of each screen relative to the other.

The corner assembly of the two screens is completed by releasably fitting an L-shaped cover plate 66 of channel-shaped cross-sectional configuration over the top of the mounting clip and the junction between the top portions of the two screens. Cover plate 66 makes a tight frictional engagement with the mounting clip and the top portions of the two frames to prevent lateral or vertical movement of any one screen relative to the other.

FIG. 6 shows a mounting assembly for joining together the tops of three screens meeting at two 90° angles to form corners for two partitioned areas and a continuous wall for the third partitioned area. In this mounting arrangement, the tops of two screens are brought together to form a corner in a manner identical to that described above for FIG. 5. The third screen then forms a second corner in a manner identical to that described above for FIG. 5. This results in an open space between the end portions of the two screens which are aligned longitudinally. As shown in FIG. 6, an upright post 152 identical in size and shape to post 52 described above is inserted in the open space between the two longitudinally aligned screens. A pair of mounting clips 154 identical in construction to mounting clips 54 described above are then frictionally engaged with the top corner portions of the screens in a manner identical to that described above for FIG. 5. In addition, a right-angle mounting clip 148 identical in construction to clip 48 described above for FIG. 4 is frictionally engaged with the adjoining top corner portions of the two screens which form the continuous planar wall, the mounting of leg 148 being identical to that described above for the clip 48 shown in FIG. 4. Mounting clips 154 and 148 combine to prevent longitudinal movement of any one of the three screens relative to the other two screens.

A T-shaped cover plate 68 of channel-shaped configuration is then fitted over the mounting clips and the junction between the three screens in a snug friction fit to prevent lateral and vertical movement of any one screen relative to the other two screens.

The top mounting assembly for the junction of four screens to form four right-angle corners is not shown in the drawings. However, such a mounting assembly is completed by arranging the screens in the orientation shown in FIG. 6 and adding a fourth screen so the end of it abuts against the outer face of post 152 and so the four screens are disposed at right angles with respect to each other. The corners of the four screens are then held in fixed positions relative to each other by the use of the four right-angle mounting clips identical in construction and use to clips 54 or 154. An X-shaped cover plate (not shown) of channel-shaped cross-sectional configuration is then fitted over the four mounting clips and the junction between the top portions of the four screens to prevent lateral and vertical movement of any one screen relative to the others.

I claim:

1. A modular sound-absorbing office screen system comprising a first sound-absorbing panel, a rigid first frame member surrounding a perimeter portion of the first sound-absorbing panel, a second sound-absorbing panel, a rigid second frame member surrounding a perimeter portion of the second sound-absorbing panel, each panel having a respective top edge and opposed front and rear sides, each frame member being of channel-shaped cross-sectional configuration and including a corresponding top surface overlying a corresponding top edge of each panel, and opposite front and rear side portions integral with the top surface thereof and overlying corresponding front and rear sides of each sound-absorbing panel, and means for releasably securing the first and second sound-absorbing panels together in an abutting relation to hold them in an upright position and in a desired orientation with respect to each other, the releasable securing means including a rigid clip member having a top portion to rest on the top surface of the abutting first and second frame members, and at least one side portion depending from the top portion thereof to be releasably disposed in an overlying relation against a separate side portion of each of the abutting frame members on the opposite sides of the junction between the two frame members, and a cover plate of channel-shaped cross-sectional configuration to be releasably disposed over the clip member and for being releasably held along opposite side portions of the first and second frame members to hold the clip member in a snug fit bridging the junction between the two frame members so as to releasably hold the first and second sound-absorbing panels in a fixed orientation relative to each other.

2. Apparatus according to claim 1 in which the releasable securing means hold the two sound-absorbing panels in an orientation in which a side portion of one frame member has an upright edge spaced from an upright edge of the other frame member, and in which the clip member further includes a first inwardly turned marginal flange extending along the edge of the side portion of the clip member remote from the top portion thereof, and a second inwardly turned marginal flange spaced from the first flange and extending along the same edge of the frame side portion as the first flange, the two flanges being arranged with respect to each other so the first flange will be releasably engaged with the upright edge of one panel frame member and so the second flange will be releasably engaged with the upright edge of the other panel frame member so the two maringal flanges cooperate with the upright edges of the two frame members to provide means for preventing longitudinal movement of one sound-absorbing panel away from the other.

3. Apparatus according to claim 2 in which the releasable securing means orient the two panels with respect to each other so the front and rear sides of the panel frame members are located on a front sound-absorbing side and a rear sound-absorbing side, respectively, of the screen system, and in which the clip member is engaged with a front side of the frame members so the marginal flanges of the clip engage upright edges of the frame members facing the front side of the screen system, and including a second one of said clip members engaged with frame members of the two panels facing the rear side of the system, the second clip having spaced apart marginal flanges engaged with corresponding upright edges of the panel frame members facing the rear side of the system.

4. Apparatus according to claim 1 in which the sound-absorbing panel comprises a sound-absorbing layer of a compressible, substantially non-cellular material capable of absorbing and dissipating sound energy.

5. Apparatus according to claim 4 in which the sound-absorbing layer comprises a batting of fibrous material.

6. Apparatus according to claim 5 in which the sound-absorbing layer comprises glass fibers.

7. Apparatus according to claim 1 in which each sound-absorbing panel is slidably disposed in the channel provided by its corresponding frame member.

8. Apparatus according to claim 7 including inwardly turned marginal flanges in the channel provided by each frame member for squeezing the perimeter portion of each sound-absorbing panel to releasably hole the sound-absorbing panels in their respective frame members.

9. A modular sound-absorbing office screen system comprising a. a first sound-absorbing panel;

b. a second sound-absorbing panel, each panel having a respective top edge and opposed front and rear sides;

c. a first frame member surrounding a perimeter portion of the first sound-absorbing panel;

d. a second frame member surrounding a perimeter portion of the second sound-absorbing panel;

e. each frame member being of channel-shaped cross-sectional configuration and including 1. a corresponding top surface overlying a corresponding top edge of each panel,
2. opposite front and rear side portions integral with the top surface of the frame member and overlying corresponding front and rear sides of each sound-absorbing panel, and
3. An upright outer edge portion extending between the front and rear side portions of the frame member,
4. the front side portion of each frame member having an upright inner edge spaced from the outer edge thereof,
5. the rear side portion of each frame member having an upright inner edge portion spaced from the outer edge thereof; and f. means for releasably securing the first and second sound-absorbing panels together in an abutting relation to hold them in an upright position and in a desired orientation relative to each other, the releasable securing means including 1. a first clip member having a top portion to rest on the top surfaces of the abutting first and second members, and a side portion to be releasably disposed in an overlying relation against a separate front side portion of each of the abutting frame members on opposite sides of the junction between the two abutting frame members,
2. a second clip member having a top portion to rest on the top surfaces of the abutting first and second frame members, and a side portion to be releasably disposed in an overlying relation against a separate rear side portion of each of the abutting frame members on opposite rear sides of the junction between the two abutting frame members,
3. the first clip member including a pair of spaced apart, inwardly turned marginal flanges extending along the side portion thereof remote from the top portion of the clip member, the two flanges being spaced from each other so each will be releasably engaged with a corresponding upright inner edge of a corresponding panel frame member so the two marginal flanges cooperate with the inner edges of the frame members to provide means for preventing longitudinal movement of one sound-absorbing panel away from the other,
4. the second clip member including a pair of spaced apart, inwardly-turned marginal flanges extending along the side portion thereof remote from the top portion of the clip member, the two flanges being spaced from each other so each will be releasably engaged with a corresponding upright inner edge of a corresponding panel frame member so the two marginal flanges cooperate with the inner edges of the frame members to provide means for preventing longitudinal movement of one sound-absorbing panel away from the other, and
5. a cover plate of channel-shaped cross-sectional configuration to be releasably disposed over the clip members and for being releasably held along opposite side portions of the first and second frame members to hold the clip members in a snug fit bridging the junction between the two frame members so as to releasably hold the first and second sound-absorbing panels in a fixed orientation relative to each other.

10. Apparatus according to claim 9 in which the sound-absorbing panel comprises a sound-absorbing layer of a compressible, substantially non-cellular material capable of absorbing and dissipating sound energy.

11. Apparatus according to claim 10 in which the sound-absorbing layer comprises a batting of fibrous material.

12. Apparatus according to claim 11 in which the sound-absorbing layer comprises glass fibers.

13. Apparatus according to claim 9 in which each sound-absorbing panel is slidably disposed in the channel provided by its corresponding frame member.

14. Apparatus according to claim 13 including inwardly-turned marginal flanges in the channel provided by each frame for squeezing the perimeter portion of each sound-absorbing panel to releasably hole the sound-absorbing panels in their respective frame members.

* * * * *

UNITED STATES PATENT AND TRADEMARK OFFICE

CERTIFICATE OF CORRECTION

PATENT NO. : 3,934,382
DATED : January 27, 1976
INVENTOR(S) : Clifford W. Gartung It is certified that error appears in the above-identified patent and that said Letters Patent are hereby corrected as shown below:

| | |
|---|---|
| Col. 3, line 54 | "4.25 les" should read --4.25#-- |
| Col. 4, line 16 | "each layer 18" should read --each glass fiber layer 18-- |
| Col. 5, line 36 | "surface" should read --surfaces-- |
| Col. 5, line 44 | "member 26" should read --member 36-- |
| Col. 6, line 2 | "attaced" should read --attached-- |
| Col. 6, line 20 | "two surfaces" should read --two top surfaces-- |
| Col. 9, line 7 | "maringal" should read --marginal-- |
| Col. 9, line 42 | "hole" should read --hold-- |
| Col. 11, line 5 | "frame for squeezing" should read --frame member for squeezing-- |
| Col. 12, line 1 | "hole" should read --hold-- |

Signed and Sealed this

*fourth* Day of *May 1976*

[SEAL]

*Attest:*

RUTH C. MASON
*Attesting Officer*

C. MARSHALL DANN
*Commissioner of Patents and Trademarks*